US008813987B2

(12) United States Patent
Oelz et al.

(10) Patent No.: US 8,813,987 B2
(45) Date of Patent: Aug. 26, 2014

(54) CONTAINER CAP WITH INNER AND OUTER PART

(76) Inventors: Alexander Markus Oelz, Cape Town (ZA); Robert James Martin, Cape Town (ZA)

( * ) Notice: Subject to any disclaimer, the term of this patent is extended or adjusted under 35 U.S.C. 154(b) by 482 days.

(21) Appl. No.: 13/120,907

(22) PCT Filed: Sep. 29, 2009

(86) PCT No.: PCT/IB2009/054261

§ 371 (c)(1),
(2), (4) Date: Mar. 24, 2011

(87) PCT Pub. No.: WO2010/038192

PCT Pub. Date: Apr. 8, 2010

(65) Prior Publication Data

US 2011/0180536 A1 Jul. 28, 2011

(30) Foreign Application Priority Data

Sep. 30, 2008 (ZA) ..... 2008/08354

(51) Int. Cl.
*B65D 47/24* (2006.01)
*B65D 47/26* (2006.01)

(52) U.S. Cl.
CPC ..... *B65D 47/263* (2013.01); *B65D 47/265* (2013.01)
USPC ..... 220/253; 220/254.4; 220/254.9; 222/516

(58) Field of Classification Search
CPC ..... B65D 47/263; B65D 47/265
USPC ..... 215/201, 217, 223, 276, 277, 43, 278; 220/203.1, 243, 253, 256.1, 259.3; 222/516, 511, 532, 483, 253, 513
See application file for complete search history.

(56) References Cited

U.S. PATENT DOCUMENTS 1,066,813 A * 7/1913 Heldridge ..... 222/516
2,636,649 A * 4/1953 Corriveau ..... 222/516
2,970,381 A * 2/1961 Pierce ..... 33/370
3,410,462 A * 11/1968 Donovan ..... 222/516

(Continued)

FOREIGN PATENT DOCUMENTS

GB 2108940 A * 5/1983 ..... B65D 55/02

*Primary Examiner* — Fenn Mathew
*Assistant Examiner* — Chetan Chandra
(74) *Attorney, Agent, or Firm* — Evans & Molinelli PLLC; Eugene Molinelli

(57) ABSTRACT

A closure (10) for a container (12) is disclosed wherein the closure has an inner part that is attachable to the container (12) around the opening of the container (12) and an outer part (20) that is receivable on the inner part (18). The inner part (18) defines at least two inner apertures (34; 36), and the outer part (20) defines at least one outer aperture (52). A bias means (60), is configured to exert a bias between the inner (18) and outer (20) parts. The outer part (20) can slide relative to the inner part (18) when received on the inner part (18), said sliding being between a rest position in which the outer aperture (52) is blocked by the inner part (18), a first dispensing position in which the outer aperture (52) is aligned with a first one of the inner apertures (36), and a second dispensing position in which the outer aperture (52) is aligned with the second of the inner apertures (34). The closure (10) is configured such that sliding of the outer part (20) towards its second dispensing position occurs against the bias.

4 Claims, 5 Drawing Sheets

(56) References Cited

U.S. PATENT DOCUMENTS

| | | | | | |
|---|---|---|---|---|---|
| 3,857,505 | A | * | 12/1974 | Mumford et al. | 215/220 |
| 3,871,522 | A | * | 3/1975 | Feldman | 206/540 |
| 3,991,908 | A | * | 11/1976 | Thomas et al. | 221/154 |
| 4,141,461 | A | * | 2/1979 | LaChance | 220/253 |
| 4,165,816 | A | * | 8/1979 | Tupper | 220/203.14 |
| 4,709,825 | A | * | 12/1987 | Mumford | 215/318 |
| 4,832,214 | A | * | 5/1989 | Schrader et al. | 215/11.1 |
| 4,986,097 | A | * | 1/1991 | Derman | 70/158 |
| 5,123,574 | A | * | 6/1992 | Poulos | 222/362 |
| 5,211,300 | A | * | 5/1993 | Hsing et al. | 215/11.4 |
| 5,738,236 | A | * | 4/1998 | Brun, Jr. | 220/253 |
| 5,821,437 | A | * | 10/1998 | Budin | 73/864.63 |
| RE39,867 | E | * | 10/2007 | Bennett et al. | 215/256 |
| 7,798,360 | B2 | * | 9/2010 | Roberts | 220/710 |
| 8,091,719 | B2 | * | 1/2012 | Wu | 215/206 |
| 8,251,263 | B2 | * | 8/2012 | DeMarco et al. | 222/483 |
| 2002/0030053 | A1 | * | 3/2002 | Copeland | 220/253 |
| 2002/0092851 | A1 | * | 7/2002 | Belcastro | 220/254.4 |
| 2002/0162816 | A1 | * | 11/2002 | Walsh | 215/11.1 |
| 2004/0256421 | A1 | * | 12/2004 | Werth | 222/480 |
| 2005/0029263 | A1 | * | 2/2005 | Ronn et al. | 220/253 |
| 2007/0187406 | A1 | * | 8/2007 | Nobile et al. | 220/254.4 |
| 2013/0032595 | A1 | * | 2/2013 | Mohadeb | 220/253 |

* cited by examiner

CONTAINER CAP WITH INNER AND OUTER PART

CROSS-REFERENCE TO RELATED APPLICATIONS

The present application is a US national phase application of PCT Application No. PCT/IB2009/054261, filed on 29 Sep. 2009, and claims priority to South Africa (ZA) Patent Application No. 2008/08354, filed 30 Sep. 2008, the entire contents of which are hereby incorporated by reference as if fully set forth herein, under 35 U.S.C. §119(b).

FIELD OF THE INVENTION

This invention relates to closures for containers, particularly for containers containing liquid substances that are to be kept out of reach of children.

BACKGROUND TO THE INVENTION

Many caps or other closures are available for containers containing hazardous substances that are to be kept out of reach of children. These caps typically twist onto screw threads of the containers and can be twisted off or can be twisted to open positions, but include mechanisms that prevent the caps from being twisted until some release actions have been performed. The release actions are usually too complex or require too much force for small children to be able to perform them, with the result that small children are unable to open these caps. However, these caps are only resistant to opening once the caps have been closed properly, which requires effort from an adult. Further, not only children find it difficult to open these caps, but some adults such as the elderly, people with arthritis, etc, struggle to open the caps and often remove substances from containers with conventional closures—where children can access them.

Many liquid preparations such as medicines for infants can be metered and/or administered conveniently by using a syringe without a needle, but in order to draw the preparation into the syringe, the container containing the preparation needs to be opened and needs to be kept open. Further, the tasks of drawing a liquid preparation from a container into a syringe and administering this to an infant and at the same having to handle the container and possibly also the infant, can be too much for a single person. The result is that containers are often opened for drawing a liquid preparation from the container and are then left open until the preparation has been administered and the infant tended, before the cap is replaced on the container. In many instances, the adult may be delayed in closing the container, e.g. if the infant requires considerable attention, with the result that the container remains open for an extended period and can be accidentally knocked over and/or could be taken by a child in the vicinity.

The problem of containers remaining open while their liquid contents are being dispensed, is not limited to metering/administration of medicines with syringes, but also occurs when the contents need to be poured, or dispensed in any other way.

Attempts have been made to address the difficulties of containers remaining open, by providing containers that open against resistance and close automatically. However, containers of this type are very inconvenient for dispensing liquids with a syringe, as it is very difficult to handle a syringe with one hand, while keeping the container open with another.

Most so-called "child-safe" container caps are twisted onto screw threads of the containers and while their release actions may be too complex for children, the children are able to open the containers by twisting the caps with enough force. It is possible also for adults who struggle with the caps or are momentarily mistaken about their operation, to apply twisting force that could break or overcome their features resisting unauthorised opening.

The present invention seeks to provide a closure for a container that resists access to its contents by small children at all times when not handled by an adult, yet allows its contents to be drawn conveniently into a syringe and/or to be poured. Further, the invention seeks to provide a closure that resists spillage and/or that resists breakage in the event that excessive twisting force is applied to it.

SUMMARY OF THE INVENTION

According to the present invention there is provided a closure for a container, said closure including:

- an inner part that is attachable to the container around the opening of the container and that defines at least two inner apertures;
- an outer part that is receivable on the inner part and that defines at least one outer aperture; and
- bias means, configured to exert a bias between the inner and outer parts;
- wherein the outer part can slide relative to the inner part, when received on the inner part, said sliding being between a rest position in which the outer aperture is blocked by the inner part, a first dispensing position in which the outer aperture is aligned with a first one of the inner apertures, and a second dispensing position in which the outer aperture is aligned with the second of the inner apertures, the closure being configured such that sliding of the outer part towards its second dispensing position occurs against the bias.

The outer part may be configured to slide between its rest position and its first dispensing position without substantial interference from the bias means and may be configured to slide from its first dispensing position to its second dispensing position against the bias.

The first inner aperture may be provided with an accessory for inhibiting spillage, such as a non-return valve. Preferably, the accessory may be a valve defining an aperture that can be opened by passing an elongate object through it, e.g. the end of a syringe and that closes when the elongate object is withdrawn from the opening.

The sliding movement between the inner and outer parts may be rotational movement, e.g. the closure may be configured so that the outer part can be twisted relative to the inner part.

The inner part may be fixedly or removably attachable to the container and may be indirectly attachable to the container via an attachment part. The inner part may be slidable relative to the attachment part. Preferably, the inner part may remain fixed relative to the attachment part and may slide relative to the attachment part when a sliding force is applied to the inner part, which exceeds a predetermined threshold.

BRIEF DESCRIPTION OF THE DRAWINGS

For a better understanding of the present invention, and to show how the same may be carried into effect, the invention will now be described by way of non-limiting example, with reference to the accompanying drawings in which.

DETAILED DESCRIPTION OF THE DRAWINGS

Figure 1:
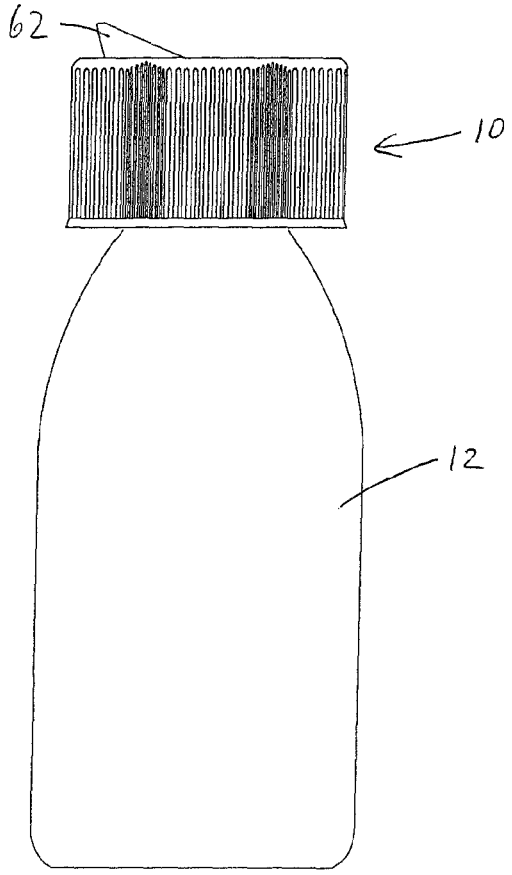
FIG. 1 is a side view of a bottle, fitted with a cap according to the present invention.

Referring to the drawings, a closure in accordance with the present invention in the form of a cap is generally indicated by reference numeral 10.

Figure 2:
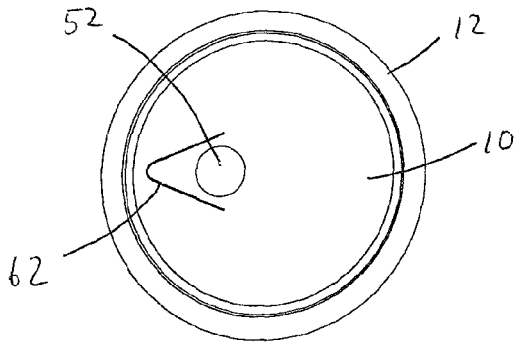
FIG. 2 is a top plan view of the bottle and cap of FIG. 1.
Figure 3:
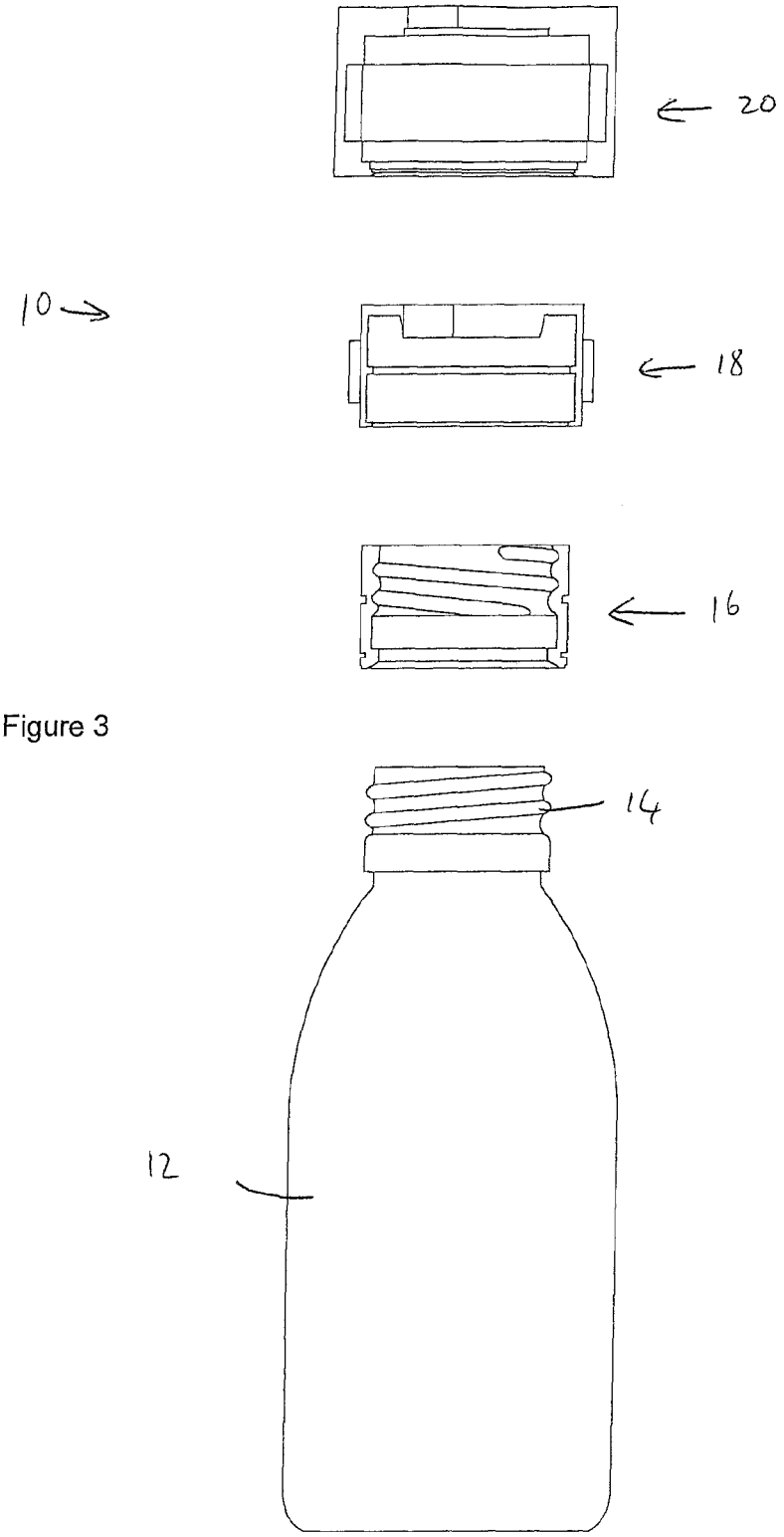
FIG. 3 is an exploded view of the bottle and main components of the cap of FIG. 1.

Referring to FIGS. 1 to 3, the cap 10 is intended for use on a container in the form of a bottle 12 with a screw thread 14 around its opening and which contains a liquid medicinal preparation. However, the principles of the present invention apply also in respect of closures for other containers containing substances to which access needs to be restricted or that needs to be prevented from being spilt.

Figure 4:
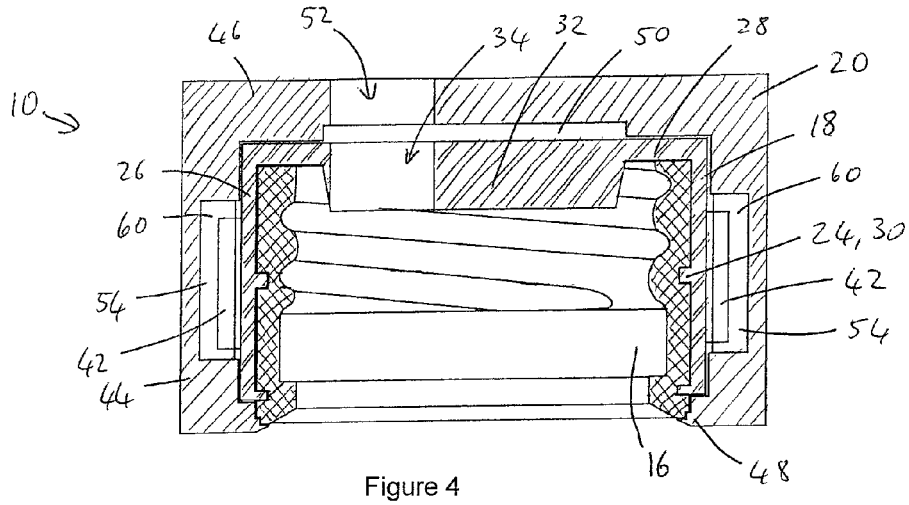
FIG. 4 is a sectional assembly view of the cap of FIG. 1.

Referring to FIGS. 3 and 4, the cap 10 includes three main components, being a thread collar 16, an inner cap 18 and an outer cap 20.

Figure 5:
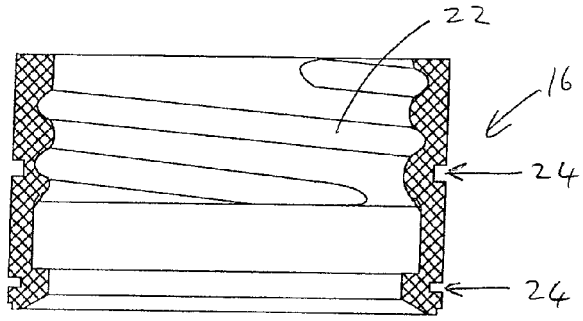
FIG. 5 is a sectional side view of a thread collar of the cap of FIG. 4.

The thread collar 16 is shown in more detail in FIG. 5 and has the general shape of a cylindrical sleeve, with a helical groove 22 on its inside, in which it can receive the bottle's screw thread 14. On the outside of the collar 16, there are two circumferential grooves 24.

Figure 6:
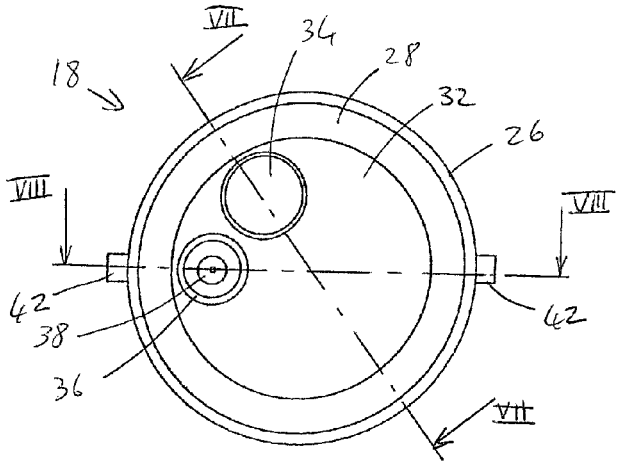
FIG. 6 is a bottom view of an inner part of the cap of FIG. 4.
Figure 7:
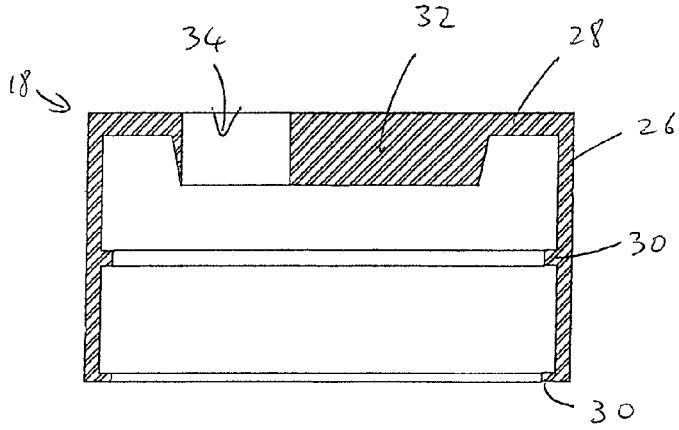
FIG. 7 is a sectional view of the inner part of FIG. 6, taken at VII-VII.
Figure 8:
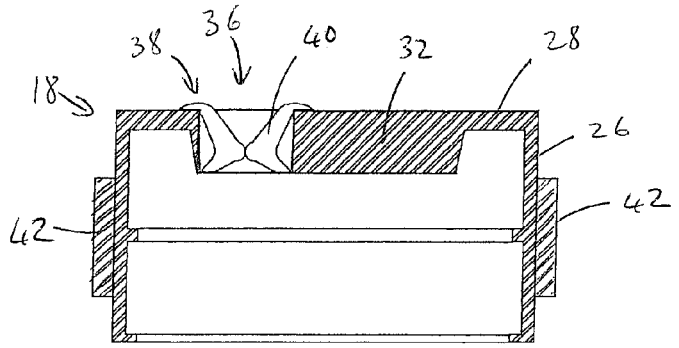
FIG. 8 is a sectional view of the inner part of FIG. 6, taken at VIII-VIII.

The inner cap 18 is shown in more detail in FIGS. 6 to 8 and includes a generally cylindrical side wall 26 and a disc-shaped end wall 28. On the inside of the side wall 26 there are two circumferential ridges 30 that are complementally shaped to the grooves 24 on the thread collar 16. The inner circumference and ridges 30 of the inner cap 18 and the outer circumference and grooves 24 of the thread collar 16 are shaped and dimensioned such that the inner cap 18 can be received on the outside of the thread collar with an interference fit, but such that the inner cap can rotate relative to the thread collar 16, with the ridges 30 sliding along the grooves 24, if a twisting force is applied that is large enough to overcome a predetermined amount of interference or friction between the components. Accordingly, the inner cap 18 is attachable to the bottle 12 via the thread collar 16, but can rotate relative to the bottle if a predetermined twisting force is applied to the inner cap.

The end wall 28 of the inner cap 18 defines a downward protuberance 32 in its centre, in which two inner apertures are defined with generally equal diameters and generally on the same radius of the end wall. The first inner aperture is a cylindrical syringe opening 36 in which an accessory in the form of a syringe valve 38 has been fitted and the second inner aperture is a cylindrical pouring opening 34. The syringe valve 38 comprises of a body of flexible material and has conical walls 40 that allow an elongate object such as the end of a syringe to enter the valve 38 from the top, pushing the walls 40 apart to open an aperture between them and to pass through the aperture 36. When the syringe end is withdrawn from the valve 38, the walls 40 contract to close the aperture and thus to close the valve. The valve 38 thus acts as a non-return valve and can inhibit or preferably prevent passage of liquid through the valve from the inside of the bottle 12.

Two diametrically opposed stop formations 42 extend from the outside of the wall 26.

Figure 9:
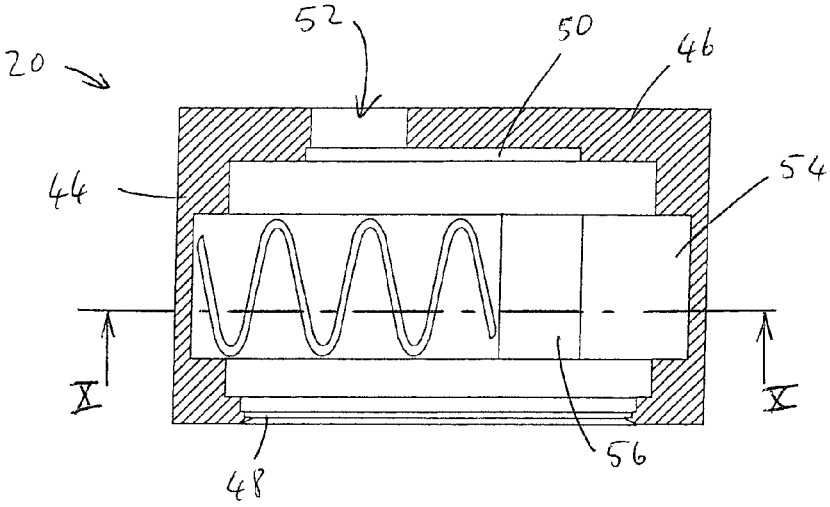
FIG. 9 is a sectional view of an outer part and spring of the cap of FIG. 4.

The outer cap 20 is shown in more detail in FIG. 9 and also includes a cylindrical side wall 44 and a disc-shaped end wall 46. At the lower end of the side wall 44, there is an inwardly facing lip 48 and the thread collar 16 and inner cap 18 can be received inside the outer cap, with the lip 48 engaging the lower periphery of the thread collar in a manner that allows the outer cap to slide easily relative to the thread collar, but to be held in place. The inner dimensions of the outer cap 20 and the outer dimensions of the inner cap 18 are configured such that the outer cap can rotate freely relative to the inner cap.

A recess 50 is defined on the underside of the end wall 46 of the outer cap 20 and an outer aperture or opening 52 is defined through the end wall 46 in the recess 52. The outer opening 52 has generally the same diameter and is disposed at generally the same radius as the pouring opening 34 and syringe opening 36.

Figure 10:
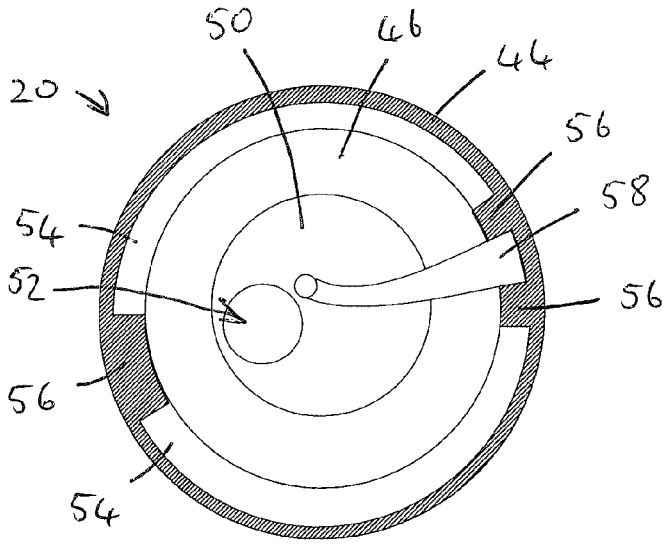
FIG. 10 is a sectional bottom view of the outer part of FIG. 9, taken at X-X.

A broad circumferential recess 54 is defined on the inside of the side wall 44 of the outer cap 20. However, the recess 54 does not extend continuously along the inner circumference of the side wall 44, but is interrupted by two diametrically opposed stop formations 56. In a preferred embodiment, a vent passage 58 is defined in the outer cap 20, extending from the recess 50, along the end wall 46 and side wall 44, inside one of the stop formations 56, to the lower rim of the outer cap. The vent passage 58 is not shown in FIGS. 4 and 9, but is shown in FIG. 10.

Figure 11:
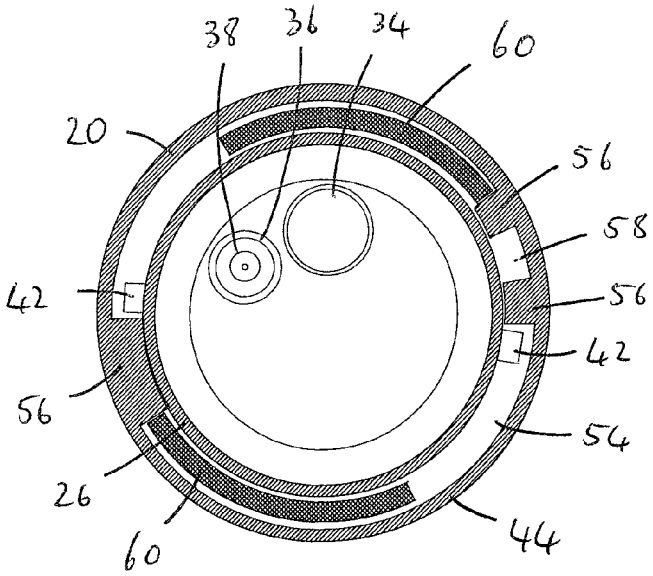
FIG. 11 is a sectional bottom view of the outer part of FIG. 10, in combination with the inner part of FIG. 5 and springs.

Bias means is provided in the form of two compression springs 60 that are received inside the recesses 54 in diametrically opposed positions. As can be seen in FIGS. 4 and 11, the stop formations 42 of the inner cap 18 protrudes outwards into the recesses 54 and each of the springs 60 extends between a stop formation 42 and a stop formation 56, so that it can exert a bias or force between the stop formations of the inner and outer caps, when it is compressed.

In use, the thread collar 16 is tightly screwed onto the bottle 12 and the inner cap 18 is received tightly, but slidably on the thread collar with the outer cap 20 easily rotatable over the thread collar and inner cap, as shown in FIGS. 3, 4 and 11.

When the cap 10 is not in use, the outer cap 20 is normally in a rest position as shown in FIG. 11, in which its outer opening 52 is aligned with neither the syringe opening 36 nor the pouring opening 34, so that it is blocked by the end wall 28 and no open path is defined for liquid to flow out of the bottle. In this rest position, each of the springs 60 only extends part of the distance between its associated stop formations 42,56.

When liquid from inside the bottle 12 is to be dispensed using a syringe, the outer cap 20 is twisted to slide from its rest position to a first dispensing position in which the syringe opening 36 is generally aligned with the outer opening 52. This twisting movement causes the stop formations 42, 56 at either end of each spring 60 to move closer together, up to or slightly beyond the point where each spring makes contact with its stop formations, but the movement is not enough to compress the springs to an extent that they exert a significant expanding bias on the stop formations. Accordingly, there is very little resistance to the sliding movement and the outer cap remains in its first dispensing position, even if no more twisting force is applied to it.

When the outer cap is in its first dispensing position, the end of a syringe can be passed through the outer opening 52 and the valve 38 and liquid can be drawn into the syringe by inverting the bottle 12. The user need not hold the cap and has both hands available for holding the bottle and/or operating the syringe. Once the syringe is withdrawn, the valve 38 closes under the resilience of its walls 40.

While the outer cap 20 is in its first dispensing position, after the syringe has been withdrawn, the one-way operation of the syringe valve 38 can allow atmospheric air to enter the bottle to compensate for the removal of liquid with the syringe, but prevents liquid from flowing out through the valve. Accordingly, even if the bottle 12 falls over if a child gets hold of the bottle, the likelihood that any liquid will flow from the bottle is minimal.

In the preferred embodiment including the vent passage 58, the inlet of the vent passage is in register with the pouring opening 34 when the outer cap is in its first dispensing position, so that the vent passage is in communication with the inside of the bottle 12 via the pouring passage and is open to atmosphere. Accordingly, atmospheric air is allowed to enter the bottle 12 via the vent passage to compensate for a pressure reduction inside the bottle when liquid is withdrawn with the syringe.

When liquid from the bottle 12 needs to be poured, the outer cap 20 is twisted to slide from its rest position or from its first dispensing, to a second dispensing position in which the outer opening 52 is aligned with the pouring opening 34, as shown in FIG. 4. During the twisting movement, the stop formations 42,56 on each side of each spring 60 move closer together to such an extent that they compress the spring, which in turn exerts an expanding force or bias that resists the twisting movement. Accordingly, if the force that a user applies to twist the outer cap, is released, the bias of the springs 60 will force the stop formations 42,56 apart and thus twist the outer cap 20 in the opposite direction.

The result is that the outer cap 20 can be twisted to its second dispensing position against the bias of the springs 60, but it needs to be held in that position against the bias while liquid from the bottle 12 is poured through the pouring opening 34 and outer opening 52. The pouring operation is also aided by a spout formation 62 provided on top of the outer cap 20 and shown in FIGS. 1 and 2.

As soon as the user releases the outer cap 20, the bias of the springs cause the outer cap to return to its first dispensing position, in which the pouring opening 34 is either closed or is in communication with the vent passage 58, but in either case, it will not be possible for substantial volumes of liquid to flow from the bottle 12.

In the event that a user exerts too large a twisting force on the outer cap 20, e.g. if an attempt is made to twist it from the first dispensing position, past the second dispensing position, or to twist it the wrong way round from its rest position, the stop formations 42,56 (possibly via the springs 60, depending on the direction of rotation) cause the twisting force to be transferred from the outer cap 20 to the inner cap 18 and if the twisting force exceeds a predetermined threshold, the friction between the inner cap and the thread collar 16 is overcome and the inner cap 18 and outer cap 20 rotate together around the thread collar. When the twisting force is released, the inner cap 18 grips the thread collar 16 again and the springs 60 expand if they had been compressed, so that the cap 10 returns to its original condition, without any damage.

The invention claimed is:

1. A closure (10) for a container (12), said closure (10) including:

an inner part (18) that is attachable to the container (12) around an opening of the container (12), said inner part (18) defining at least one inner aperture (34);

an outer part (20) that is receivable on the inner part (18) and that defines at least one outer aperture (52); and bias means (60), configured to exert a bias between the inner (18) and outer (20) parts;

wherein the outer part (20) can rotate relative to the inner part (18), when received on the inner part (18), said rotation being between a rest position in which the outer aperture (52) is blocked by the inner part (18) and a dispensing position in which the outer aperture (52) is aligned with the inner aperture (34);

characterised in that said bias means (60) includes two compression springs (60) that are disposed at diametrically opposed positions, each of said compression springs extending in a circumferential direction between a formation (42) of the inner part (18) and a formation (56) of the outer part (20).

2. The closure (10) as claimed in claim 1, characterized in that said bias means (60) extends along at least two circumferential recesses (54) defined inside the outer part (20).

3. The closure (10) as claimed in claim 1, characterized in that said bias means (60) is configured such that rotation of the outer part (20) towards the dispensing position occurs against the bias for at least some of the rotation.

4. The closure (10) as claimed in claim 3, characterized in that said outer part (20) is configured to slide from the rest position in the direction of the dispensing position without substantial bias from the bias means (60).

* * * * *